US008007382B1

(12) United States Patent
Sanford

(10) Patent No.: US 8,007,382 B1
(45) Date of Patent: Aug. 30, 2011

(54) EXPANDABLE ARROW BROADHEAD WITH TWO-PIECE FOLDING CUTTING BLADES

(76) Inventor: Chris G. Sanford, Billings, MT (US)

( * ) Notice: Subject to any disclaimer, the term of this patent is extended or adjusted under 35 U.S.C. 154(b) by 606 days.

(21) Appl. No.: 11/810,285

(22) Filed: Jun. 5, 2007

(51) Int. Cl.
*F42B 6/08* (2006.01)

(52) U.S. Cl. ..... 473/583

(58) Field of Classification Search ..... 473/583
See application file for complete search history.

(56) References Cited

U.S. PATENT DOCUMENTS 2,993,697 A * 7/1961 Urban ..... 473/583
4,973,060 A * 11/1990 Herzing ..... 473/583
4,976,443 A * 12/1990 DeLucia ..... 473/583
4,998,738 A * 3/1991 Puckett ..... 473/583
5,066,021 A * 11/1991 DeLucia ..... 473/583
5,082,292 A * 1/1992 Puckett et al. ..... 473/583
6,165,086 A * 12/2000 Liechty, II ..... 473/583
6,200,237 B1 * 3/2001 Barrie ..... 473/583
6,517,454 B2 * 2/2003 Barrie et al. ..... 473/583
6,669,586 B2 * 12/2003 Barrie et al. ..... 473/583
7,226,375 B1 * 6/2007 Sanford ..... 473/583

* cited by examiner

*Primary Examiner* — John Ricci
(74) *Attorney, Agent, or Firm* — Edwin H. Crabtree; Ramon L. Pizarro

(57) ABSTRACT

An expandable arrow broadhead used for releasable attachment to one end of a hollow arrow shaft. The arrow broadhead includes a pair of two-piece, folding cutting blades pivotally attached to a side of sliding shaft housing and a tip base. The tip base is part of a sliding shaft received in a collar bore in the sliding shaft housing. The cutting blades include a front cutting blade pinned to a rear pivot arm. The front cutting blade includes an outer cutting edge and an inner edge. The cutting blades are held in a retracted position during arrow flight using a flexible band received around a portion of the cutting blades or a coil spring received around the sliding shaft and mounted in the collar bore. Upon target contact, the folding cutting blades are extended outwardly from the side of the sliding shaft housing for increased penetration in the target.

18 Claims, 2 Drawing Sheets

EXPANDABLE ARROW BROADHEAD WITH TWO-PIECE FOLDING CUTTING BLADES

BACKGROUND OF THE INVENTION (a) Field of the Invention

This invention relates broadly to an expandable arrow broadhead and more particularly, but not by way of limitation, to an arrow broadhead having a sliding shaft with a pointed tip. The sliding shaft is received through a hollow collar mounted on a sliding shaft housing. The broadhead is characterized by having a pair of two-piece, folding cutting blades. During arrow flight, the folding cutting blades are held in a retracted position using a flexible band or a coil spring. Upon target contact, the folding cutting blades are extended outwardly from the side of the sliding shaft housing for increased penetration in the target.

(b) Discussion of Prior Art

Heretofore, there have been a number of arrow broadheads having blades that extend outwardly when contacting a surface of a target. U.S. Pat. No. 6,935,976 to Grace, Jr. et al., discloses a mechanical broadhead having blades, mounted in longitudinal channels in a ferrule, that slide outwardly on a camming surface formed in an inward edge of each blade. U.S. Pat. No. 6,270,435 to Sodaro illustrates an arrowhead having spring loaded blades that expand outwardly upon contact with a target. U.S. Pat. Nos. 6,910,979, 6,626,776 and 6,517,454 to Barrie et al. disclose blades having longitudinal grooves in the blades and a camming member for extending the blades outwardly upon target impact. U.S. Pat. Nos. 6,669,586 and 6,200,237 to Barrie disclose blades mounted on a sliding body mounted on a length of the broadhead. As the sliding body moves rearwardly upon target impact, the blades engage a camming surface and are moved outwardly in an extended position.

None of the above mentioned prior art broadhead patents particularly disclose or teach the structure and function of an arrow broadhead having a sliding shaft with a pointed tip and a pair of two-piece, folding cutting blades. The sliding shaft is designed to move rearwardly upon target impact with the cutting blades expanding outwardly from the sliding shaft housing for increased target penetration.

SUMMARY OF THE INVENTION

In view of the foregoing, it is a primary objective of the subject invention to provide an aerodynamic, arrow broadhead that maintains a pair of two-piece, folding cutting blades in a retracted position, typically having an in-flight diameter of 0.55 inches, and next to a sliding shaft housing for little or no deflection at target contact. The arrow broadhead flight is similar to an arrow with field tip flight. This feature eliminates the need to adjust sight pins, which is a common complaint of mechanical and fixed broadheads, especially with bows that shoot over 300 fps. The folding cutting blades are held in the retracted position using a releasable, flexible band releasably attached to the blades or a coil spring mounted inside a collar bore hole.

Another primary objective of the invention is using the broadhead's forward inertia and using a sliding shaft moving rearward in a hollow collar mounted in a front portion of a sliding shaft housing to almost instantaneously upon target contact move the folding cutting blades into a fully extended position. The forward inertia of the arrow broadhead and the extension of the blades provide for an ultimate penetration of the target. This feature results in larger entry and exit holes, better blood trails and higher game recovery.

The subject arrow broadhead includes a pair of two-piece, folding cutting blades pivotly attached to a side of sliding shaft housing and a tip base. The cutting blades include a front cutting blade pinned to a rear pivot arm. The tip base is part of a sliding shaft received in a collar bore in the sliding shaft housing. Each of the blades includes an outer cutting edge and an inner edge. The cutting blades are held in a retracted position during arrow flight using a flexible band or a coil spring mounted in the collar bore.

These and other objects of the present invention will become apparent to those familiar with the use of arrow broadheads for hunting when reviewing the following detailed description, showing novel construction, combination, and elements as described, and more particularly defined by the claims, it being understood that changes in the embodiments to the disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for it's practical application and in which.

DETAILED DESCRIPTION OF THE PREFERRED EMBODIMENTS

Figure 1:
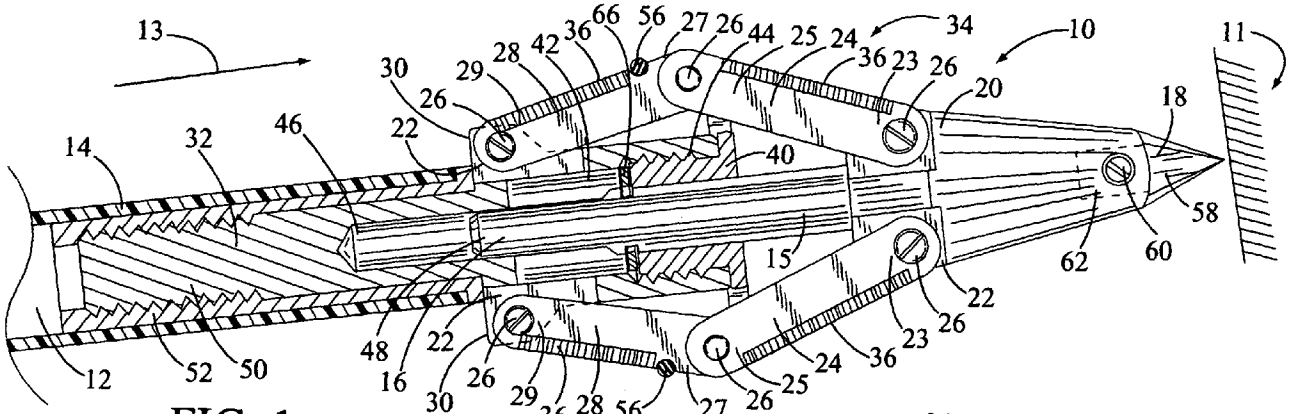
FIG. 1 is a perspective view of the subject arrow broadhead in flight and prior to target contact. The folding cutting blades are shown in a retracted position next to a side of a sliding shaft housing a flexible band held thereon. The sliding shaft housing with attached threaded, hollow collar is shown in cross-section. The sliding shaft housing is used for receiving a portion of a sliding shaft attached to a pointed tip. A lower end of the sliding shaft housing is attached to an arrow shaft insert in a hollow arrow shaft.

In FIG. 1, a perspective view of the subject aerodynamic arrow broadhead is shown in flight and having general reference numeral 10. In this drawing, the broadhead 10 is heading toward a target, having a general reference numeral 11. The flight of the broadhead 10 is indicated by arrow 13. The arrow broadhead 10 is adapted from mounting to an open end 12 of a hollow arrow shaft 14. A portion of the arrow shaft 14 is shown in cross section.

The arrow broadhead 10 includes a sliding shaft 16 with a pointed tip 18 disposed in a front portion 15 of the shaft 16. The sliding shaft 16 has an annular cross section, but it could have other geometric cross sections if desired for receipt and sliding inside the broadhead 10. The pointed tip 18 is tapered rearwardly and outwardly forming a tip base 20. It should be mentioned that while the shaft 16, the pointed tip 18 and the tip base 20 can be a one-piece unit, the front portion 15 of the shaft 16 can also be threaded, press fit, pinned or glued into an opening in the bottom of the tip base 20. This feature of threading, press fitting or pining the front portion 15 of the shaft in an opening in the bottom of the tip base 20 is not shown in the drawings.

The tip base 20 includes cutting blade grooves 22 formed therein and parallel to a length of the sliding shaft 16. The cutting blade grooves 22 are used for receiving a front pivot end 23 of a front cutting blade 24 and pinned thereon using a pivot pin 26. A rear pivot end 25 of the front cutting blade 24 is pinned to a front pivot end 27 of a rear pivot arm 28. A rear pivot end 29 of the rear pivot arm 28 is pinned inside grooves 22 in raised studs 30. The studs 30 are disposed in a side of a sliding shaft housing 32.

The front cutting blade 24 and the rear pivot arm 28 combine to form a two-piece, folding cutting blade, shown in the drawings having a general reference numeral 34. The front cutting blades 24 include an outer cutting edge 36 and an inner edge 38. The inner edge 32 of the blades 26 is disposed next to a portion of a length of the sliding shaft 16. The rear pivot arm 28 can also include an outer cutting edge 36 and a inner edge 38 or it can be merely used as pivot arm without the added feature of an outer cutting edge. While a pair of folding cutting blades 34 are shown in the drawings, the broadhead 10 could also have three folding cutting blades 34 equally spaced around the side of the sliding shaft housing and tip base.

In this drawing, a portion of the sliding shaft 16 is slidably received inside and through a hollow collar 40. The exterior of the collar 40 is threaded into a top portion of a sliding shaft housing 32. The hollow collar 40 acts as a cylinder for allowing the shaft 16 to slide rearward at target contact. The sliding shaft housing 32 includes a collar bore hole 42 with an threaded upper end 44. The threaded upper end 44 of the collar bore hole 42 is used for threading the hollow collar 40 thereon. Also, the hollow collar 40 can be press fitted in the collar bore hole 42. Further, the hollow collar 40 can be threaded or press fitted around an outside of a top portion of the sliding shaft housing 32.

Also, the sliding shaft housing 32 includes a smaller, sliding shaft lower bore hole 46 for receiving a lower end portion 48 of the sliding shaft 16. While the lower bore hole 46 is shown to add strength to the sliding shaft housing 32 for receiving the sliding shaft 16, the shaft 16 could be shortened and slide only inside the collar bore hole 42, thus eliminating the need of the lower bore hole 46.

A threaded lower end 50 of the sliding shaft housing 32 is used for attachment to an arrow shaft insert 52 in the hollow arrow shaft 14. The lower end 50 can also be without threads and attached to the arrow shaft insert 52 in a press fit. Typical, hunting arrows include the arrow shaft insert 52, therefore, the arrow broadhead 10 can be easily attached to different types of arrows by merely threading or press fitting the sliding shaft housing 32 into the arrow shaft insert 52 as shown.

The outer cutting edge 36 of the rear pivot arm 28 includes an outer notch 54 for receiving a portion of a flexible band 56 or like blade retaining device for holding the blades 34 in a folded, retracted position. While the notch 54 is shown in the rear pivot arm 28, it could also be placed in various position along the length of the rear pivot arm 28 and front cutting blade 24 as long as the band doesn't interfere with the extension of the blades upon target contact. Also, the band 56 helps prevent the sliding shaft 16 from sliding rearward and inward in the collar 40 during the flight of the arrow and prematurely extending the blades 34 outwardly in an extended position as shown. The band 56 is shown in cross section and can be made of rubber or flexible plastic.

Further shown in this drawing and as an option, the pointed tip 18 can include a removable, razor sharp, replaceable tip 58. A dulled or damaged tip 58 can be removed and replaced by removing a locking pin 60. The locking pin 60 is threaded into the tip base 20 and through a lower end portion 62 of the tip 58. The lower end portion 62 is received in a groove in the front of the tip base 20.

Figure 2:
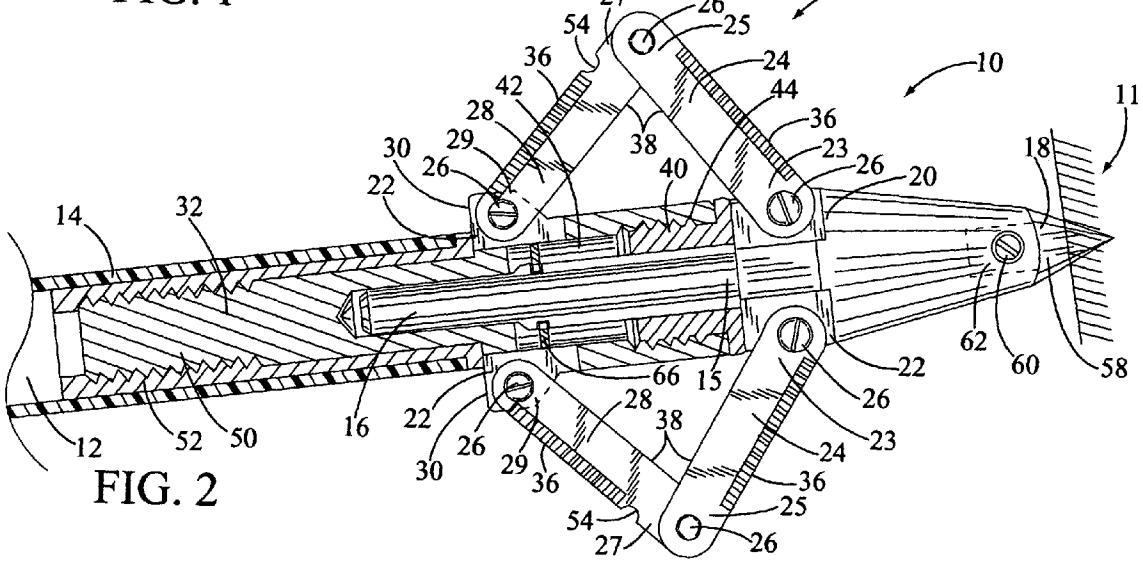
FIG. 2 is another perspective view of the arrow broadhead with the folding cutting blades in a extended position upon target contact.

In FIG. 2, another perspective view the arrow broadhead 10 is shown with the pointed tip 18 contacting the target 11. Upon target contact, the sliding shaft 16 moves rearward sliding in the hollow collar 40 with the lower end portion 48 of the shaft 16 received in the lower bore hole 46. As the sliding shaft 16 moves rearward, the flexible band 56 is released from the notch 56 and the front cutting blade 24 and the rear pivot arm 28 pivot upwardly on pivot pins 26 into an extended position as shown in this drawing.

Figure 3:
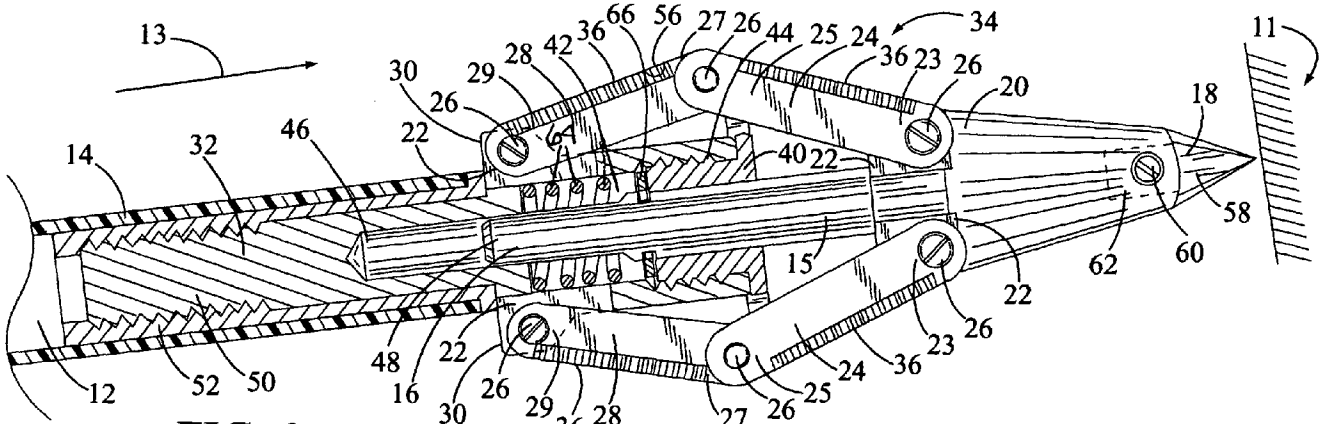
FIG. 3 is still another perspective view of the subject arrow broadhead in flight and prior to target contact. The folding cutting blades are shown in a retracted position next to a side of a sliding shaft housing. A coil spring is shown received inside a collar bore in the sliding shaft housing for biasing the sliding shaft with pointed tip forward and holding the folding cutting blades in the retracted position.

In FIG. 3, the broadhead 10 is similar to the broadhead 10 shown in FIGS. 1 and 2 except, in this example, the cutting blades 34 don't require the use of the flexible band to hold the blades in a retracted position.

In the collar bore hole 42 of the sliding shaft housing 32 is a coil spring 64, mounted therein and shown in cross section. The coil spring 64 is received around the lower end portion 48 on the sliding shaft 16. The coil spring 62 is biased against a ring keeper 66 for pushing the sliding shaft 16 and pointed tip 18 forward toward the direction of the target 11. At this time, the two-piece, folding cutting blades is biased downwardly next to the side of the sliding shaft housing 32 and into a retracted position during arrow flight.

Figure 4:
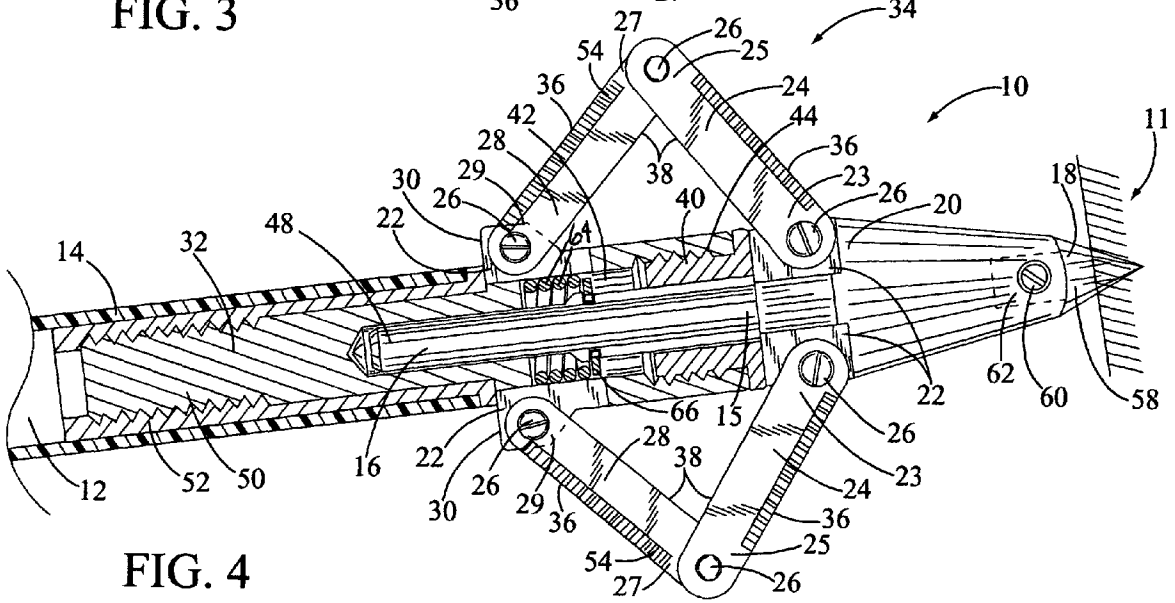
FIG. 4 is yet another perspective view of the arrow broad with the folding cutting blades fully extended outwardly from the sliding shaft housing upon target contact with the coil spring compressed inside the collar bore.

In FIG. 4, the broadhead 10 is shown with the cutting blades 34 in a fully extended position upon contact of the pointed tip 18 on the target 11. When the pointed tip 18 contacts the target 11, the sliding shaft 16 moves rearward with the lower end portion 48 moving into the lower borehole 46 and compressing the coil spring 64 as shown. At this time, the folding cutting blades 34 move outwardly pivoting on the pivot pins 26 into the extended position with the outer cutting edge 36 of the front cutting blade positioned for engaging the target 11. As mentioned above, the feature of the use of the coil spring 62 inside the collar bore hole 42 eliminates the need of having to use an external, flexible band around the blades 34 to keep them in a retracted position during arrow flight.

While the invention has been particularly shown, described and illustrated in detail with reference to the preferred embodiments and modifications thereof, it should be understood by those skilled in the art that equivalent changes in form and detail may be made without departing from the true spirit and scope of the invention as claimed except as precluded by the prior art.

The embodiments of the invention for which an exclusive privilege and property right are claimed are defined as follows:

1. An arrow broadhead adapted for attaching to an open end of a hollow arrow shaft, the broadhead adapted for moving from a retracted position during arrow flight to an extended position when contacting a target, the broadhead comprising:

a sliding shaft having a pointed tip, said pointed tip disposed in a front portion of said shaft, said pointed tip tapered rearwardly and outwardly forming a tip base;

a sliding shaft housing having a bore hole therein and a lower end, said sliding shaft housing receiving said sliding shaft therein, a lower end portion of said sliding shaft received in said bore hole, the lower end of said sliding shaft housing adapted for receipt inside the open end of the hollow arrow shaft;

a pair of two-piece, folding cutting blades pivotally attached to said tip base and said sliding shaft housing, said folding cutting blades having an outer cutting edge; and biasing means for holding said folding cutting blades in a retracted position during arrow flight;

whereby, when said pointed tip contacts a target, said sliding shaft moves rearward in said bore hole and said folding cutting blades are pivoted outwardly from said sliding shaft housing into an extended position.

2. The broadhead as described in claim 1 further including a hollow collar for receiving a portion of said sliding shaft therethrough, said hollow collar threaded inside said bore hole in said sliding shaft housing.

3. The broadhead as described in claim 1 wherein said pointed tip with tip base is formed into a one-piece unit with said sliding shaft.

4. The broadhead as described in claim 1 wherein a front portion of said sliding shaft is threaded into an opening in the tip base of said pointed tip.

5. The broadhead as described in claim 1 wherein a front portion of said sliding shaft is press fitted into an opening in the tip base of said pointed tip.

6. The broadhead as described in claim 1 wherein said biasing means is a blade retaining band received in a notch in said blades, said flexible band for holding said blades in a retracted position during flight.

7. The broadhead as described in claim 1 wherein said biasing means is a coil spring received in said bore hole in said sliding shaft housing, said coil spring received around a portion of said sliding shaft from biasing said shaft and said pointed tip forward toward the target and holding said blades in a retracted position.

8. An arrow broadhead adapted for attaching to an open end of a hollow arrow shaft, the broadhead adapted for moving from a retracted position during arrow flight to an extended position when contacting a target, the broadhead comprising:

a sliding shaft having a pointed tip, said pointed tip disposed in a front portion of said shaft, said pointed tip tapered rearwardly and outwardly forming a tip base;

a sliding shaft housing having a bore hole therein and a lower end, said sliding shaft housing receiving said sliding shaft therein, a lower end portion of said sliding shaft received in said bore hole, the lower end of said sliding shaft housing adapted for receipt inside the open end of the hollow arrow shaft;

a pair of two-piece, folding cutting blades, said cutting blades including a front cutting blade with an outer cutting edge, said front cutting blade pivotally attached to said tip base and to a rear pivot arm, said rear pivot arm pivotally attached to a side of said sliding shaft housing; and a blade retaining band releaseably attached to said cutting blades for holding said blades in a retracted position during arrow flight;

whereby, when said pointed tip contacts a target, said sliding shaft moves rearward in said bore hole and said folding cutting blades are pivoted outwardly from said sliding shaft housing into an extended position.

9. The broadhead as described in claim 8 wherein a portion of said blade retaining band is received in a notch in the rear pivot arm of said cutting blades.

10. The broadhead as described in claim 8 wherein the rear pivot arm of said cutting blades includes an outer cutting edge.

11. The broadhead as described in claim 8 wherein said pointed tip includes a replaceable tip received in a groove therein and pinned thereto.

12. The broadhead as described in claim 8 further including a hollow collar for receiving a portion of said sliding shaft therethrough, said hollow collar attached to a front portion of said sliding shaft housing.

13. The broadhead as described in claim 8 further including an arrow shaft insert adapted for receipt in the open end of the hollow arrow shaft, the lower end of said sliding shaft housing attached to said arrow shaft insert.

14. An arrow broadhead adapted for attaching to an open end of a hollow arrow shaft, the broadhead adapted for moving from a retracted position during arrow flight to an extended position when contacting a target, the broadhead comprising:

a sliding shaft having a pointed tip, said pointed tip disposed in a front portion of said shaft, said pointed tip tapered rearwardly and outwardly forming a tip base;

a sliding shaft housing having a bore hole therein and a lower end, said sliding shaft housing receiving said sliding shaft therein, a lower end portion of said sliding shaft received in said bore hole, the lower end of said sliding shaft housing adapted for receipt inside the open end of the hollow arrow shaft;

a pair of two-piece, folding cutting blades, said cutting blades including a front cutting blade with an outer cutting edge, said front cutting blade pivotally attached to said tip base and to a rear pivot arm, said rear pivot arm pivotally attached to a side of said sliding shaft housing; and a coil spring received in said bore hole in said sliding shaft housing, said coil spring received around a portion of said sliding shaft from biasing said shaft and said pointed tip forward toward the target and holding said blades in a retracted position;

whereby, when said pointed tip contacts a target, said sliding shaft moves rearward in said bore hole and said folding cutting blades are pivoted outwardly from said sliding shaft housing into an extended position.

15. The broadhead as described in claim 14 wherein the rear pivot arm of said cutting blades includes an outer cutting edge.

16. The broadhead as described in claim 14 wherein said pointed tip includes a replaceable tip received in a groove therein and pinned thereto.

17. The broadhead as described in claim 14 further including a hollow collar for receiving a portion of said sliding shaft therethrough, said hollow collar attached to a front portion of said sliding shaft housing.

18. The broadhead as described in claim 14 further including an arrow shaft insert adapted for receipt in the open end of the hollow arrow shaft, the lower end of said sliding shaft housing attached to said arrow shaft insert.

* * * * *